US005118658A

United States Patent [19]

Egashira et al.

[11] Patent Number: 5,118,658

[45] Date of Patent: Jun. 2, 1992

[54] HEAT TRANSFER SHEET

[75] Inventors: Noritaka Egashira; Masashi Narita; Hideo Fujimura; Yoshinori Nakamura, all of Tokyo, Japan

[73] Assignee: Dai Nippon Insatsu Kabushiki Kaisha, Japan

[21] Appl. No.: 597,696

[22] Filed: Oct. 16, 1990

[30] Foreign Application Priority Data

Oct. 26, 1989 [JP] Japan ..... 1-277107
Aug. 24, 1990 [JP] Japan ..... 2-221187

[51] Int. Cl.[5] ..... B41M 5/035; B41M 5/26

[52] U.S. Cl. ..... 503/227; 428/195; 428/423.1; 428/913; 428/914

[58] Field of Search ..... 8/471; 428/195, 913, 428/914, 423.1; 503/227

[56] References Cited

FOREIGN PATENT DOCUMENTS 111004 6/1984 European Pat. Off. ..... 503/227

*Primary Examiner*—Pamela R. Schwartz
*Attorney, Agent, or Firm*—Parkhurst, Wendel & Rossi

[57] ABSTRACT

A heat transfer sheet including a substrate film having thereon a due layer including a dye and a binder, wherein the binder includes a urethane-modified cellulosic resin obtained by the reaction of a hydroxyl group-containing cellulosic resin with an isocyanate.

5 Claims, No Drawings

HEAT TRANSFER SHEET

BACKGROUND OF THE INVENTION

The present invention relates to a heat transfer sheet and, more particularly, to a heat transfer sheet which is useful for heat transfer systems using sublimable (or thermally migrating) dyes and is so improved in storability and dye migration at the time of heat transfer that it can impart a much more improved density to the resulting image.

As replacements to generally available typographic and printing techniques, ink jet, heat transfer and other systems have been developed to provide excellent monochromatic or full-color images in a simple and fast manner. The most excellent of all is the so-called sublimation heat transfer system making use of a sublimable dye, which provides a full-color image having an improved gradation or gray scale and comparable to a color photograph.

In general, a heat transfer sheet used with the sublimation type of transfer system typically includes a substrate film such as a polyester film, which is provided on one side with a dye layer comprising a sublimable dye and a binder and on the other side with a heat-resistant layer for preventing it from sticking to a thermal head.

The dye layer of such a heat transfer sheet is overlaid on an imageable or image-receiving material having an image-receiving layer formed of polyester or other resin, and heat is applied to the heat transfer sheet from its back side in an imagewise manner, thereby causing the dye in the dye layer to migrate onto the image-receiving material to form the desired image.

According to such a heat transfer system as mentioned above, only the dye migrates from the dye layer into the image-receiving material, leaving the binder on the substrate film. In this case, the better the dye migration, the clearer and denser the resulting image. Thus, it is preferred to use as that binder a resin having a reduced or limited affinity for the dye used. From such a point-of-view, wide use has so far been made of cellulosic resins less dyeable with dyes.

A problem with forming the dye layer with the cellulosic resin, however, is that, as a result of the cellulosic resin having a low compatibility with the resin, the dye tends to precipitate out and crystallize during the storage of the heat transfer sheet, giving rise to a sharp drop of its sensitivity and thus failing to give an image of high density.

SUMMARY OF THE INVENTION

It is therefore an object of this invention to provide a heat transfer sheet which is so improved in storability and dye migration at the time of heat transfer that it can impart a much more improved density to the resulting image.

According to this invention, the aforesaid object is achieved by the provision of a heat transfer sheet including a substrate film provided thereon with a dye layer comprising a dye and a binder, wherein said binder is an urethane-modified cellulosic resin obtained by the reaction and combination of a hydroxyl group containing cellulosic resin with an isocyanate.

By forming the dye layer using as a binder the cellulosic resin obtained by allowing the cellulosic resin to react with the isocyanate to rid the former of the hydroxyl group, it is possible to provide a heat transfer sheet which, even after stored over an elongated period, suffers no precipitation of the dye from the dye layer, and is so improved in storability and dye migration at the time of heat transfer that it can impart a much more improved density to the resulting image.

ILLUSTRATIVE EXPLANATION OF THE INVENTION

The present invention will now be explained in greater detail with reference to its preferred embodiments.

The heat transfer sheet according to this invention, which is basically obtained by forming a dye layer on a substrate film, as is the case with the prior art, is characterized in that the cellulosic resin, of which the hydroxyl group is rid by reaction with the isocyanate, is provided as a binder.

For the substrate film of the heat transfer sheet according to this invention, use may be made of any film so far known to have some heat resistance and strength. Mention, for instance, is made of paper, various processed papers, polyester films, polystyrene films, polypropylene films, polysulfone films, aramid films, polycarbonate films, polyvinyl alcohol films and cellophane, all having a thickness of 0.5 to 50 μm, preferably 3 to 10 μm. Particular preference, however, is given to polyester films. These substrate films may be in a continuous or discontinuous form, although not limited thereto. Among these substrate films, the most preference is given to polyethylene terephthalate films previously treated on their surfaces in such a way that they are easily bondable to other objects.

No particular limitation is imposed upon the dyes used in this invention. All dyes so far used for conventional known heat transfer sheets may be effectively used in this invention. Mention, for instance, is made of red dyes such as MS Red G, Macrolex Red Violet R, Ceres Red 7B, Samaron Red HBSL and Resolin Red F3BS; yellow dyes such as Phorone Brilliant Yellow 6GL, PTY-52 and Macrolex Yellow 6G; and blue dyes such as Kayaset Blue, Vacsolin Blue AP-FW, Phorone Brilliant Blue S-R and MS Blue 100.

As the binder resins to carry such dyes as mentioned above, use may be made of cellulosic resins having a hydroxyl group in their structures, cellulose, regenerated cellulose and cellulose derivatives such as carboxymethylcellulose, ethyl cellulose, hydroxyethyl cellulose, ethylhydroxycellulose, hydroxypropyl cellulose, methyl cellulose, cellulose diacetate, cellulose triacetate, cellulose acetate propionate and cellulose acetate butylate. These cellulosic resins may further be modified with silicone, fluorine or a long-chain alkyl into releasable resins.

Of the aforesaid cellulosic resins, particular preference is given to an acetylcellulose having a degree of acetylation in the range of 2.0 to 2.9.

The isocyanates for reaction with the cellulosic resins are preferably monoisocyanates, illustrative examples of which are:

n-propyl isocyanate,
isopropyl isocyanate,
n-butyl isocyanate,
t-butyl isocyanate,
n-octadecyl isocyanate,
palmitoyl isocyanate,
stearyl isocyanate,
lauryl isocyanate,
phenyl isocyanate, p-nitrophenyl isocyanate,
p-chlorophenyl isocyanate,
cyclohexyl isocyanate, and
α-methylbenzyl isocyanate.

Of course, it is to be understood that the foregoing compounds are referred to for the purpose of illustration alone. All various aliphatic or aromatic mono- or polyisocyanates so far used as the starting materials of polyurethane, etc. may be used in this invention.

Among the isocyanate compounds used in this invention, particular preference is given to straight- or branched-chain alkyl monoisocyanates having 3-20 carbon atoms, which may contain in their chains bond groups such as —O—, —S—, COO—, —OOC—, —NHCOO—, —OOCHN—, —CONH—, —NHCO—, $—SO_2NH—$, $—NHSO_2—$, $—SO_2—$ and $—O_2S—$ or other substituents such as a phenyl group.

When the isocyanates are monocyanates, their reaction with the cellulosic resins may be effected before, during or after forming the dye layer. In the case of polyisocyanates, however, they should preferably be allowed to react with the cellulosic resins during or after forming the dye layer, since the resulting binders are prone to gelate. In view of the fact that such reaction is timeconsuming and the productivity of the heat transfer sheets, however, it is preferred that the reaction of the cellulosic resins with the isocyanates be effected prior to forming the dye layer. For urethanation, it is preferred that the unreacted hydroxyl groups in the cellulosic resin be all urethanated. However, sufficient effects may also be obtained by the urethanation of the unreacted hydroxyl groups in the cellulosic resin at a concentration of at most 15 mol %, preferably at most 10 mol %. That urethanation is easily well-achieved by heat used at the drying step for forming the dye layer.

Particularly preferred urethanated cellulosic resins are urethanated acetylcelluloses having a degree of acetylation in the range of 2.0 to 2.9 and a degree of urethanation in the range of 1.0 to 0.1.

In the present invention, it is preferred to add a sensitizer to the dye layer when forming it. Such a sensitizer is a low-molecular-weight substance having a relatively low melting point, say, 50°-150° C. A substance whose melting point is below 50° C. may be used as well, but it offers a handling problem such as sticking or blocking. A substance with a melting point higher than 150° C., on the other hand, is unpreferred, because it gives rise to a drastic drop of sensitization.

Preferably, the sensitizer used in this invention has a molecular weight in the range of 100 to 1,500. At a molecular weight below 100 difficulty is encountered in keeping a melting point of 50° C. or higher. A sensitizer having a molecular weight higher than 1,500, on the other hand, is unpreferred, because its melting is not so sharp at the time of heat transfer that it can fail to produce a sufficient sensitizing effect.

Preferably, the sensitizer is used at a proportion of 1-100 parts by weight per 100 parts of the dye layer-forming binder. In an amount below 1 part by weight no satisfactory sensitization is obtained, whereas in an amount higher than 100 parts by weight there is a drop of the heat resistance of the dye layer.

The sensitizers used may be any low-molecular-weight substances heretofore known in the art. The preferable sensitizers preferably used in this invention, for instance, are various oligomers such as polyurethane, polystyrene, polyester, polyacryl, polyethylene, polyvinyl chloride, polyvinyl acetate, ethylene/vinyl acetate copolymer, ethylene/acryl copolymer, polyoxyethylene, polyoxypropylene and polyoxyethylene oligomers; fatty acids such as myristic, palmitic, margaric, stearic, arachic and montanic acids; fatty acid amides such as caproic, caprylic, lauric, stearic, oleic and eicosenoic acid amides; and fatty acid esters such as behenic acid methyl, lignoceric acid methyl, montanic acid methyl, palmitic acid pentadecyl, stearic acid hexacosyl and carbamic acid [1,4-phenylenebis(methylene)]bisdimethyl ester; aromatic compounds such as 1,4-dicyclohexylbenzene, benzoic acid, aminobenzophenone, dimethyl terephthalate, fluorothene, phenols, naphthalenes and phenoxides; and various waxes.

With sensitizers obtained by the reaction of the above-mentioned isocyanates with sensitizers having in their structures functional groups reactive with the isocyanates such as hydroxyl and amino groups, it is possible to achieve further improvements in storability and dye migration, since such sensitizers show a much more improved compatibility with the dye or binder. Noteworthy in this case, however, is that it is preferable to use monoisocyanates. This is because polyisocyanates deactivate the sensitizers, when they are polyfunctional. What is mentioned in connection with the reaction of the binders with the isocyanates also holds for the reaction of the sensitizers with the isocyanates.

The sensitizers particularly preferable for this invention are compounds expressed by the following general formula (I):

$$(CH_2)_n—[NHCOO—X—Y—Z]_2 \quad (I)$$

wherein X is a straight- or branched-chain alkylene group which may have a substituent; Y stands for a single bond or a bond group such as —O—, —S—, COO—, —OOC—, —NHCOO—, —OOCHN—, —CONH—, —NHCO—, $—SO_2NH—$, $—NHSO_2—$, $—SO_2—$ or $—O_2S—$; Z denotes a hydrogen atom or a straight- or branched-chain alkyl or phenyl group which may have a substituent and/or an unsaturated group, and n indicates an integer of 1 or more.

The compounds having Formula (I) may be obtained by the reaction of an aliphatic diisocyanate compound with an equivalent proportion of an aliphatic alcohol represented by the following general formula (II):

$$HO—X—Y—Z \quad (II)$$

wherein X, Y and Z have the same meanings as defined above.

Particularly preferable examples of these compounds are:

$$\begin{array}{l} NHCOOCH_2COOC_2H_5 \\ | \\ (CH_2)_6 \\ | \\ NHCOOCH_2COOC_2H_5 \end{array} \quad \text{No. 1}$$

$$\begin{array}{l} NHCOO(CH_2)_2COOC_2H_5 \\ | \\ (CH_2)_6 \\ | \\ NHCOO(CH_2)_2COOC_2H_5 \end{array} \quad \text{No. 2}$$

$$\begin{array}{l} NHCOOC(CH_3)_2COOCH_3 \\ | \\ (CH_2)_6 \\ | \\ NHCOOC(CH_3)_2COOCH_3 \end{array} \quad \text{No. 3}$$

-continued

No. 4

$$\begin{array}{l} NHCOO(CH_2)_2OCH(CH_3)_2 \\ | \\ (CH_2)_6 \\ | \\ NHCOO(CH_2)_2OCH(CH_3)_2 \end{array}$$

No. 5

$$\begin{array}{l} NHCOOCH_2C_6H_4CH_2SCH_3 \\ | \\ (CH_2)_6 \\ | \\ NHCOOCH_2C_6H_4CH_2SCH_3 \end{array}$$

No. 6

$$\begin{array}{l} NHCOO(CH_2)_2CH_3 \\ | \\ (CH_2)_6 \\ | \\ NHCOO(CH_2)_2CH_3 \end{array}$$

No. 7

$$\begin{array}{l} NHCOOCH(Cl)OCH_3 \\ | \\ (CH_2)_6 \\ | \\ NHCOOCH(Cl)OCH_3 \end{array}$$

No. 8

$$\begin{array}{l} NHCOO(CH_2)_2OCOC_6H_5 \\ | \\ (CH_2)_6 \\ | \\ NHCOO(CH_2)_2OCOC_6H_5 \end{array}$$

No. 9

$$\begin{array}{l} NHCOO(CH_2)_2OCOCH{=}CH_2 \\ | \\ (CH_2)_6 \\ | \\ NHCOO(CH_2)_2OCOCH{=}CH_2 \end{array}$$

No. 10

$$\begin{array}{l} NHCOOC_6H_4CONHC_6H_5 \\ | \\ (CH_2)_6 \\ | \\ NHCOOC_6H_4CONHC_6H_5 \end{array}$$

The heat transfer sheet according to this invention, for instance, may be obtained by coating at least one side of the substrate film with a solution or dispersion in which the dye, binder and isocyanate are dissolved or dispersed in a suitable organic solvent or water together with the required additives such as an urethanation catalyst and a release agent with the use of, e.g., gravure printing, screen printing or reverse roll coating with a gravure, and drying the resultant coating to form the dye layer.

Having a thickness of 0.2 to 5.0 μm, preferably about 0.4 to 2.0 μm, the thus formed dye layer may preferably contain 5 to 90% by weight, particularly 10 to 70% by weight of the sublimable dye.

When the desired image is monochromatic, one dye may be selected from the aforesaid dyes to form a monochromatic dye layer. When the desired image is fully chromatic, on the other hand, suitable cyan, magenta and yellow (if required, black) dyes may be selected to form a dye layer of yellow, magenta and cyan (if required, black).

As the imageable or image-receiving material used with such a heat transfer sheet as mentioned above to form an image, use may be made of any material with its recording side being of dye receptivity. When formed of paper, metals, glass or synthetic resin having no dye-receptivity, it may be provided with a dye-receiving layer on at least one side.

As means for applying heat energy used for carrying out heat transfer with such heat transfer sheets and image-receiving materials as mentioned above, all applicator means so far known in the art may be used. For instance, the desired image may be obtained by applying a heat energy of about 5–100 mJ/mm$^2$ for a controlled time with recording hardware such as a thermal printer (e.g., Video Printer VY-100 made by Hitachi, Ltd.).

The present invention will now be explained more illustratively with reference to reference examples, examples and comparative examples wherein, unless otherwise stated, the "part" and "%" are given by weight.

REFERENCE EXAMPLES 1–9

Preparation of Urethane-Modified Cellulose

The cellulosic resins and isocyanates, set out in Table 1, were allowed to react with each other at 60° C. for 170 hours to obtain urethane-modified cellulosic resins used in this invention, which were found to have the following degrees of urethanation by NMR analysis.

TABLE 1

| Ref. Ex. Nos. | A | B | C |
|---|---|---|---|
| 1 | 2.7 | stearyl | 0.3 |
| 2 | 2.3 | palmitoyl | 0.7 |
| 3 | 2.7 | palmitoyl | 0.3 |
| 4 | 2.4 | n-butyl | 0.6 |
| 5 | 2.1 | n-butyl | 0.9 |
| 6 | 2.8 | n-butyl | 0.2 |
| 7 | 2.4 | stearyl | 0.6 |
| 8 | 2.4 | phenyl | 0.6 |
| 9 | 1.8 | n-butyl | 1.2 |

A: Degrees of acetylation of the acetylcellulose used.
B: Substituents of the isocyanates used.
C: Degrees of urethanation of the products.

EXAMPLES 1–26 AND COMPARATIVE EXAMPLES 1–7

Used as substrate films were 6-μm thick polyethylene terephthalate films subjected to a heat-resistant treatment on their back sides or surfaces on which no dye layers were to be formed. The dye layer-forming ink compositions, set out in Table 2, were then coated on the front surfaces of such films to a dry coverage of 1.0 g/m$^2$ by gravure printing. Subsequent drying gave heat transfer sheets according to this invention and for comparison, all in a continuous film form.

TABLE 2

| Examples | Dyes (part) | Binders (part) | Sensitizers (part) | Solvents (part) |
|---|---|---|---|---|
| 1 | Kayaset Blue 714 (10) | Ref. Ex. 1 (10) | Not used | Methylene chloride (79) |
| 2 | Kayaset Blue 714 (10) | Ref. Ex. 1 (10) | Stearic acid amide (1) | Methylene chloride (79) |
| 3 | Kayaset Blue 714 (10) | Ref. Ex. 1 (10) | *1 (1) | Methylene chloride (79) |
| 4 | Kayaset Blue 714 (10) | Ref. Ex. 2 (10) | Not used | Methylene chloride (79) |
| 5 | Kayaset Blue 714 (10) | Ref. Ex. 2 (10) | Stearic acid amide (1) | Methylene chloride (79) |
| 6 | Kayaset Blue 714 (10) | Ref. Ex. 3 (10) | Not used | Methylene chloride (79) |
| 7 | Kayaset Blue 714 (10) | Ref. Ex. 3 (10) | Stearic acid amide (1) | Methylene chloride (79) |
| 8 | Kayaset Blue 714 (10) | Ref. Ex. 4 (10) | No. 1 above (2) | Methylene chloride (79) |
| 9 | Kayaset Blue 714 (10) | Ref. Ex. 4 (10) | No. 2 above (2) | Methylene chloride (79) |
| 10 | Kayaset Blue 714 | Ref. Ex. 4 (10) | No. 3 above (2) | Methylene chloride |

TABLE 2-continued

| Examples | Dyes (part) | Binders (part) | Sensitizers (part) | Solvents (part) |
|---|---|---|---|---|
| | (10) | | | (79) |
| 11 | Kayaset Blue 714 (10) | Ref. Ex. 4 (10) | No. 4 above (2) | Methylene chloride (79) |
| 12 | Kayaset Blue 714 (10) | Ref. Ex. 4 (10) | No. 5 above (2) | Methylene chloride (79) |
| 13 | Kayaset Blue 714 (10) | Ref. Ex. 4 (10) | No. 6 above (2) | Methylene chloride (79) |
| 14 | Kayaset Blue 714 (10) | Ref. Ex. 4 (10) | No. 7 above (2) | Methylene chloride (79) |
| 15 | Kayaset Blue 714 (10) | Ref. Ex. 4 (10) | No. 8 above (2) | Methylene chloride (79) |
| 16 | Kayaset Blue 714 (10) | Ref. Ex. 4 (10) | No. 9 above (2) | Methylene chloride (79) |
| 17 | Kayaset Blue 714 (10) | Ref. Ex. 4 (10) | No. 10 above (2) | Methylene chloride (79) |
| 18 | Kayaset Blue 714 (10) | Ref. Ex. 4 (10) | No. 2 above (0.5) | Methylene chloride (79) |
| 19 | Kayaset Blue 714 (10) | Ref. Ex. 4 (10) | No. 2 above (2) | Methylene chloride (79) |
| 20 | Kayaset Blue 714 (10) | Ref. Ex. 5 (10) | No. 2 above (2) | Methylene chloride (79) |
| 21 | Kayaset Blue 714 (10) | Ref. Ex. 6 (10) | No. 2 above (2) | Methylene chloride (79) |
| 22 | Kayaset Blue 714 (10) | Ref. Ex. 7 (10) | No. 3 above (2) | Methylene chloride (79) |
| 23 | Kayaset Blue 714 (10) | Ref. Ex. 8 (10) | No. 3 above (2) | Methylene chloride (79) |
| 24 | Kayaset Blue 714 (10) | Ref. Ex. 9 (10) | No. 2 above (2) | Methylene chloride (79) |
| 25 | Kayaset Blue 714 (10) | Ref. Ex. 4 (10) | Not used (2) | Methylene chloride (79) |
| 26 | Kayaset Blue 714 (10) | Ref. Ex. 6 (10) | Not used | Methylene chloride (79) |
| Comp. Ex. 1 | Kayaset Blue 714 (10) | Acetylcellulose not modified with urethane, used in Ref. Ex. 1 (10) | Not used | Methylene chloride (79) |
| Comp. Ex. 2 | Kayaset Blue 714 (10) | Acetylcellulose not modified with urethane, used in Ref. Ex. 1 (10) | Not used | Methylene chloride (79) |
| Comp. Ex. 3 | Kayaset Blue 714 (10) | Acetylcellulose (with a degree of acetylation of 2.2) (10) | No. 2 above | Methylene chloride (79) |
| Comp. Ex. 4 | Kayaset Blue 714 (10) | Acetylcellulose (with a degree of acetylation of 2.9) (10) | No. 2 above | Methylene chloride (79) |
| Comp. Ex. 5 | Kayaset Blue 714 (10) | Acetylcellulose (with a degree of acetylation of 2.2) (10) | Not used | Methylene chloride (79) |
| Comp. Ex. 6 | Kayaset Blue 714 (10) | Acetylcellulose (with a degree of acetylation of 2.9) (10) | Not used | Methylene chloride (79) |
| Comp. Ex. 7 | Kayaset Blue 714 (10) | Acetylcellulose (with a degree of acetylation of 3.0) (10) | No. 2 above | Methylene chloride (79) |

Kayaset Blue 714: C.I. Solvent Blue 63 made by Nippon Kayaku K.K.
*[1]Urethane-modified oligomer represented by Ph = $[(CH_2)_2—NHCOO—(CH_2)_3—CH_3]_2$ The following coating solution was coated on one side of a substrate film formed of synthetic paper (Yupo FPG150 made by Oji Yuka K.K.) to a dry coverage of 4.5 g/m$^2$. Subsequent 30-minute drying at 100° C. gave a heat transfer image-receiving sheet used according to this invention and for comparison.

| Dye Receptor Layer-Forming Coating Solution | |
|---|---|
| Polyester resin (Vylon 600 made by Toyobo Co., Ltd.) | 4.0 parts |
| Vinyl chloride/vinyl acetate copolymer (#1000A made by Denki Kagaku K.K.) | 6.0 parts |
| Amino-modified silicone oil (X-22-3050 made by The Shin-Etsu Chemical Co., Ltd.) | 0.2 parts |
| Epoxy-modified silicone oil (X-22-3000C made by The Shin-Etsu Chemical Co., Ltd.) | 0.2 parts |
| Methyl ethyl ketone | 44.8 parts |
| Toluene | 44.8 parts |

HEAT TRANSFER TESTING

Each of the heat transfer sheets according to the examples and comparative examples was combined with the heat transfer image-receiving sheet with the dye layer and image-receiving layer being opposite to each other, and thermal head recording was made from the back side of the heat transfer sheet with a thermal head (KMT-85-6, MPD2) under the following conditions:

Head application voltage: 12.0 V,

Applied pulse width: stepwise pattern according to which it was decreased from 16.0 msec. per line at an interval of 1 msec., and Sub-scanning line: 61 lines/mm (33.3 msec. per line).

The relative sensitivities of the resulting images were found. Further, the heat transfer sheets were stored at 60° C. and 30% RH for 200 hours, after which printing was carried out in the same manner as mentioned above. The results are reported in Table 3 along with those of offset and blocking..

TABLE 3

| | Relative sensitivity | | | |
|---|---|---|---|---|
| | Before testing | After testing | Offset | Blocking |
| Ex. 1 | 1.5 | 1.4 | 5 | 5 |
| Ex. 2 | 2.2 | 2.0 | 4 | 4 |
| Ex. 3 | 2.0 | 1.9 | 4 | 4 |
| Ex. 4 | 1.3 | 1.3 | 5 | 4 |
| Ex. 5 | 1.8 | 1.8 | 4 | 4 |
| Ex. 6 | 1.6 | 1.5 | 4 | 5 |
| Ex. 7 | 2.2 | 2.1 | 4 | 4 |
| Ex. 8 | 2.1 | 2.2 | 5 | 5 |
| Ex. 9 | 2.3 | 2.3 | 5 | 5 |
| Ex. 10 | 2.2 | 2.1 | 4 | 4 |
| Ex. 11 | 2.3 | 2.2 | 5 | 5 |
| Ex. 12 | 2.0 | 2.0 | 4 | 5 |
| Ex. 13 | 2.2 | 2.3 | 5 | 5 |
| Ex. 14 | 2.0 | 2.1 | 5 | 5 |
| Ex. 15 | 2.1 | 2.1 | 5 | 4 |

TABLE 3-continued

| | Relative sensitivity | | | |
|---|---|---|---|---|
| | Before testing | After testing | Offset | Blocking |
| Ex. 16 | 2.3 | 2.2 | 5 | 5 |
| Ex. 17 | 2.0 | 2.0 | 4 | 5 |
| Ex. 18 | 1.6 | 1.6 | 5 | 5 |
| Ex. 19 | 2.8 | 2.6 | 4 | 4 |
| Ex. 20 | 2.2 | 2.2 | 5 | 5 |
| Ex. 21 | 2.1 | 2.1 | 5 | 4 |
| Ex. 22 | 2.1 | 2.0 | 5 | 5 |
| Ex. 23 | 1.5 | 1.4 | 5 | 5 |
| Ex. 24 | 2.2 | 2.0 | 4 | 4 |
| Ex. 25 | 2.0 | 1.9 | 4 | 4 |
| Ex. 26 | 1.3 | 1.3 | 5 | 4 |
| Comp. Ex. 1 | 1.0 | 0.5 | 2 | 3 |
| Comp. Ex. 2 | 0.8 | 0.4 | 1 | 3 |
| Comp. Ex. 3 | 1.7 | 1.1 | 1 | 1 |
| Comp. Ex. 4 | 1.5 | 1.0 | 1 | 1 |
| Comp. Ex. 5 | 1.0 | 0.6 | 4 | 5 |
| Comp. Ex. 6 | 1.1 | 0.9 | 3 | 5 |
| Comp. Ex. 7 | 1.3 | 0.8 | 3 | 1 |

The relative sensitivity was determined by measuring the density of the printed image and comparing it with that of Comparative Example 1 before testing −1.0.

The offset was determined by overlaying the sample on the backside of a dye film and allowing them to stand in a dry state of 40° C. under a load of 20 g/cm$^2$ for 60 hours, and was estimated as below:

5: the dye did not migrate onto the backside of the dye film at all.

4: the dye migrated slightly onto the backside of the dye film.

3: the dye migrated onto the backside of the dye film to such an extent that half that backside was dyed.

2: the dye migrated onto the backside of the dye film to such an extent that three-forths of that backside was dyed.

By permitting the sensitizer to be contained in the dye layer, it is possible to provide an image of satisfactory density with a printing energy lower than used with the prior art. With the same printing energy as conventionally used, it is possible to provide an image of even higher density.

We claim:

1. A heat transfer sheet comprising a substrate film having a dye layer formed thereon, said dye layer comprising a heat migratable dye and a binder, said binder comprising a urethane-modified cellulosic resin obtained by the reaction of a hydroxyl group-containing cellulosic resin with a monoisocyanate.

2. A heat transfer sheet as claimed in claim 1, wherein the hydroxyl group-containing cellulosic resin is an acetylcellulose having a degree of acetylation in the range of 2.0 to 2.9.

3. A heat transfer sheet as claimed in claim 1, wherein the dye layer further comprises a sensitizer, said sensitizer being a low--melting compound having a molecular weight in the range of 100 to 1,500.

4. A heat transfer sheet as claimed in claim 3, wherein said sensitizer is present in an amount of 1 to 100 parts by weight per 100 parts by weight of said binder.

5. A heat transfer sheet as claimed in claim 3, wherein the sensitizer is a compound represented by the following general formula (I):

$$(CH_2)_n—[NHCOO—X—Y—Z]_2 \quad (I)$$

wherein:

X is a straight- or branched-chain alkylene group which may have a substituent;

Y is a single bond or a bond group selected from the group consisting of —O—, —S—, COO—, —OOC—, —NHCOO—, —OOCHN—, —CONH—, —NHCO—, —$SO_2$NH—, —NH-$SO_2$—, —$SO_2$—, or —$O_2$S—;

Z is a hydrogen atom or a straight- or branched-chain alkyl or phenyl group which may have a substituent and/or an unsaturated group, and n is an integer of 1 or more.

* * * * *